US007553220B2

(12) United States Patent
Smith

(10) Patent No.: US 7,553,220 B2
(45) Date of Patent: Jun. 30, 2009

(54) RETRACTABLE ABRASIVE SHARPENER AND CARRYING CASE

(75) Inventor: Richard S. Smith, Hot Springs, IL (US)

(73) Assignee: Smith Abrasives, Inc., Hot Springs, AR (US)

( * ) Notice: Subject to any disclaimer, the term of this patent is extended or adjusted under 35 U.S.C. 154(b) by 0 days.

(21) Appl. No.: 11/974,195

(22) Filed: Oct. 11, 2007

(65) Prior Publication Data

US 2008/0132159 A1 Jun. 5, 2008

Related U.S. Application Data

(63) Continuation of application No. 11/301,358, filed on Dec. 13, 2005, now abandoned, which is a continuation of application No. 11/065,268, filed on Feb. 25, 2005, now abandoned.

(51) Int. Cl.
*B24B 19/00* (2006.01)

(52) U.S. Cl. ..... 451/451; 76/81.3; 451/461; 451/523; 451/45

(58) Field of Classification Search ..... 76/81, 76/81.3, 81.4, 81.5, 81.8, 82, 84; 451/45, 451/523, 524, 552, 556, 917, 451, 461
See application file for complete search history.

(56) References Cited

U.S. PATENT DOCUMENTS

| | | | | | |
|---|---|---|---|---|---|
| 201,115 | A | * | 3/1878 | Lombard | 451/540 |
| 618,880 | A | | 2/1899 | Humphrey | |
| 1,394,927 | A | * | 10/1921 | Martin | 76/84 |
| 2,125,566 | A | | 8/1938 | Hill | |
| 2,194,525 | A | | 3/1940 | Nordberg | |
| 2,418,430 | A | | 4/1947 | Schief | |
| 2,948,167 | A | | 8/1960 | Spano | |
| 3,436,870 | A | * | 4/1969 | Sellman | 451/540 |
| 3,718,938 | A | | 3/1973 | Blume | |
| 3,735,542 | A | | 5/1973 | Kocian | |
| 3,861,087 | A | | 1/1975 | Martin | |
| 4,069,528 | A | * | 1/1978 | Newton et al. | 7/170 |
| 4,094,106 | A | * | 6/1978 | Harris | 451/555 |
| 4,197,677 | A | * | 4/1980 | Graves | 451/555 |
| 4,558,540 | A | | 12/1985 | Collins | |
| D297,209 | S | * | 8/1988 | Cohen | D8/91 |
| 5,520,574 | A | | 5/1996 | Wilson | |
| 5,594,966 | A | | 1/1997 | Goldman | |
| D461,386 | S | * | 8/2002 | Ray | D8/93 |
| 6,676,490 | B1 | | 1/2004 | Kendhammer | |
| 2004/0213623 | A1 | | 10/2004 | McLaughlin | |

* cited by examiner

*Primary Examiner*—Timothy V Eley
(74) *Attorney, Agent, or Firm*—Edward D. Gilhooly

(57) ABSTRACT

A hand held retractable abrasive sharpener having a rod formed with a tapered end portion and a partially cylindrical opposite end portion. A part of the partially cylindrical opposition end portion is flat. A slot is formed in the rod. Substantially all of the outer surfaces include layers of the rod have an abrasive material. The rod is carried in a carrying case for transport and storage in a locked relationship and being capable of being released and withdrawn for sharpening with carrying case serving as a holder.

6 Claims, 5 Drawing Sheets

RETRACTABLE ABRASIVE SHARPENER AND CARRYING CASE

This application is a continuation of non-provisional application, Ser. No. 11/301,358 filed Dec. 13, 2005, now abandoned, which is a continuation of non-provisional application Ser. No. 11/065/268 filed Feb. 25, 2005, now abandoned.

BACKGROUND OF THE INVENTION

1. Field of the Invention

This invention relates in general to abrasive sharpeners and, more particularly, to a hand held retractable sharpener for knives, tools, fishing hooks, and the like.

2. Summary of the Prior Art

Many prior art designs have been developed for manually sharpening numerous implements, including knives, tools, fishing hooks, serrated edges and the like. There exists a need in the prior art for an economical sharpener that effectively sharpens knives, tools, fishing hooks and the like at any location. Many prior art sharpeners are inconvenient to use and do not provide for easy transport and storage. It is therefore desirable in the prior art to provide a hand held sharpener capable of quality sharpening of all kinds of knives including serrated edges, a wide range of tools, and fishing hooks utilizing a retractable, easy to carry design.

SUMMARY OF THE INVENTION

It is therefore an objective of the invention to provide an improved, hand held retractable sharpener and carrying case capable of giving a razor sharp edge to all kinds of knives, tools, and fishing hooks. The sharpener herein is compact and easily carried on one's person, such as in a shirt or other pocket, or in any other transport means. The sharpener of the invention is provided with a durable shaping rod having a round partially cylindrical section and flat surface for sharpening flat or serrated edges, and an opposite tapered conical like section primarily intended for serrated edges. The rod is carried in a hollow carrying case for ease of transport. The rod is secured in the hollow carrying case by a locking mechanism having a tightening cap that retains the rod in the carrying case in a first storage and transport position and in a second sharpening position. In the sharpening position, the carrying case serves as grip able holder in a sharpening mode. The cylindrical section of the rod is provided with a slot for sharpening fishing hooks. Multiple layers of diamond grit abrasives are applied to all surfaces of partial cylindrical section, including the flat surface and the slot, and the tapered section.

DESCRIPTION OF THE PREFERRED EMBODIMENT

Figure 1:
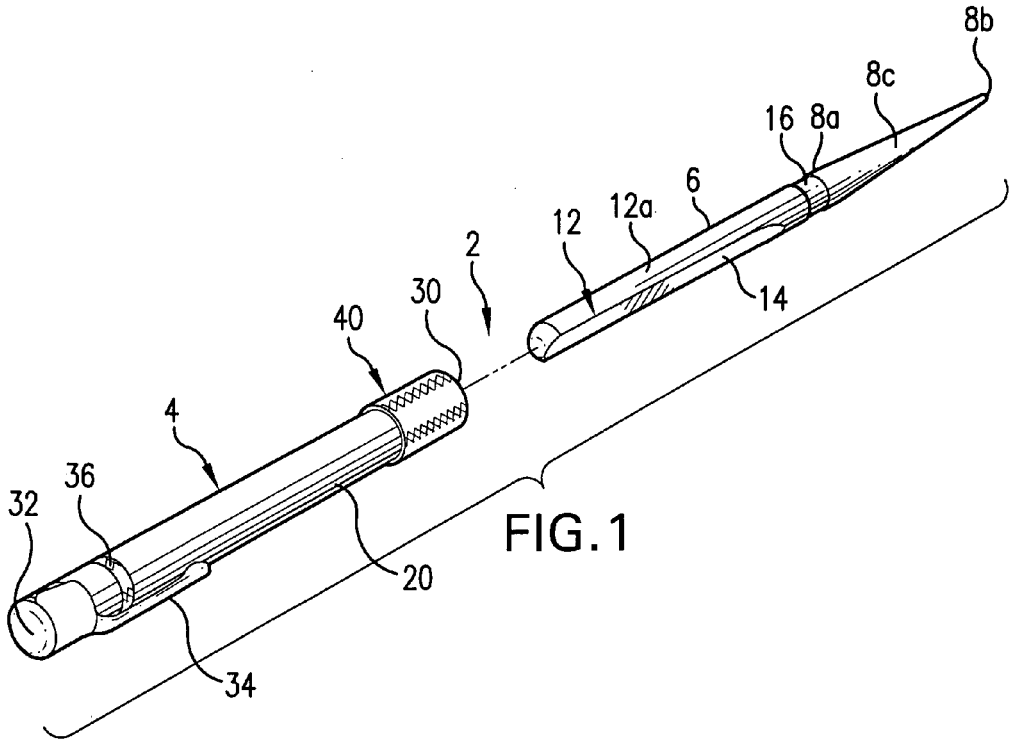
FIG. 1 is a front perspective view of the hand held retractable abrasive sharpener with the sharpening rod and carrying case in a separated configuration.
Figure 2:
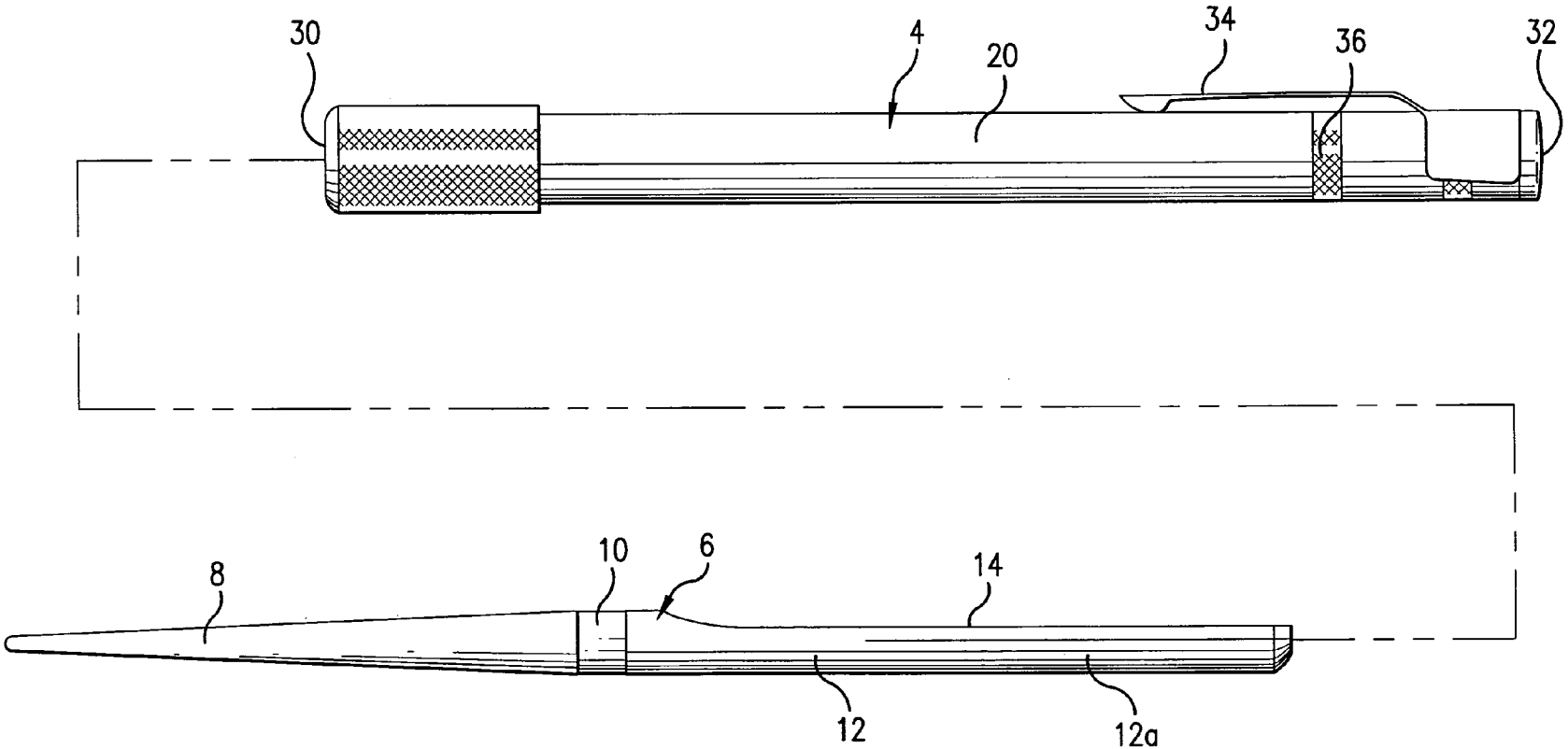
FIG. 2 is a side elevational view of the abrasive sharpener of FIG. 1 with the rod and carrying case in a separated configuration.
Figure 3:
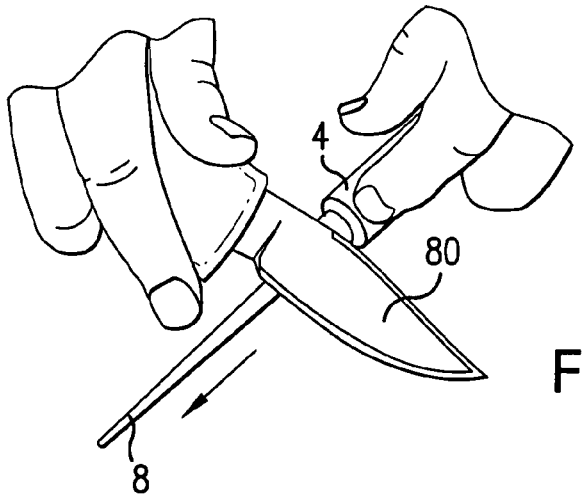
FIG. 3 is a perspective side view of the abrasive sharpener of FIG. 1 being used to sharpen a generally flat edge knife.

Referring now to FIGS. 1, 2, and 3 there illustrated the hand held retractable abrasive sharpener of the invention, generally designated by reference numeral 2. In separated form as shown in FIGS. 1, 2, and 3, the carrying case 4 is shown and with be described later. The abrasive sharpener 2 includes a solid, one piece rod 6 that is formed from a metal material, such as steel, aluminum, and the like. The rod 6 possesses an end section 8 in a tapered shape commencing from a maximum outer diameter at area 8*a* and terminating in a near pointed end 8*b*. The end section 8 is formed in a frusto-conical or near conical configuration to define the tapered shape and form outer surface 8*c*.

Figure 4:
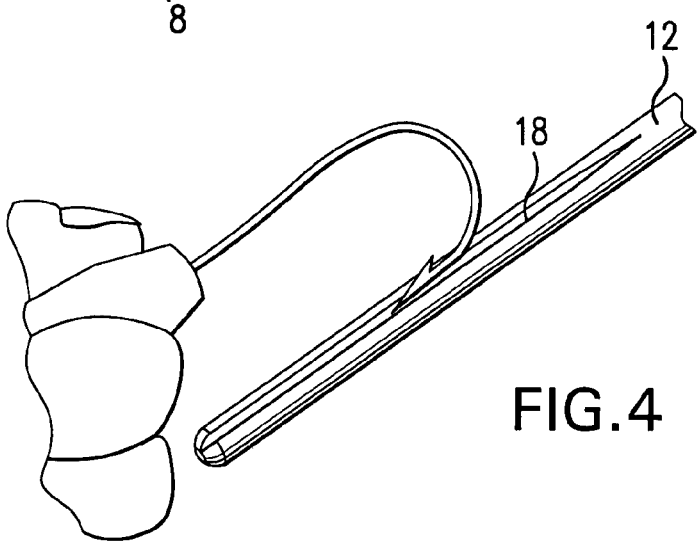
FIG. 4 is a perspective side view of the abrasive sharpener of FIG. 1 being used to sharpen a fishing hook.
Figure 6:
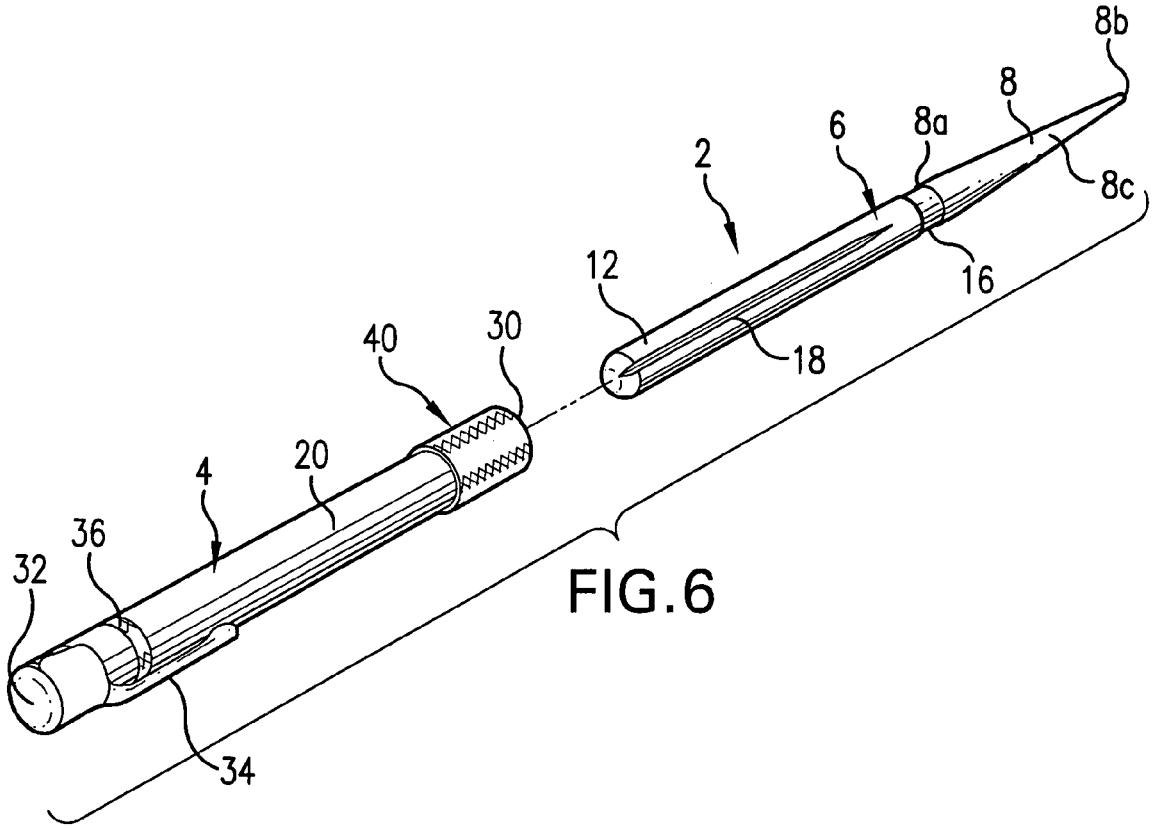
FIG. 6 is a bottom perspective view of the abrasive sharpener of FIG. 1 showing the slot of the rod.

The opposite end section 12 possesses a partial cylindrical configuration provided forming outer surface 12*a* and a longitudinally extending flat surface 14 (FIGS. 2 and 3). A cylindrical mid-section 16 separates the tapered end section 8 from the opposite, partially cylindrical opposite end section 12. As seen in FIGS. 4 &6, an elongated slot 18 is provided longitudinally along the surface of end section 12. Multiple layers of an abrasive grit, such as diamonds or other suitable abrasives, are provided on substantially all of the surface 8*c* of the tapered end section 8, the surface 12*a* of partial cylindrical section, on flat surface 14 of end section 12, and in the slot 18 to provide multiple abrasive sharpening surfaces for attaining sharp edges on the edges of a large number of implements to be sharpened.

In FIGS. 1, 2, and 3 the carrying case 4 is shown as a hollow cylindrical tube 20 having an open end 30 for receiving a portion of rod 6 and a closed opposite end 32. The cap 6 may be formed from a metal, plastic, or like material. The tube 20 is provided with a shirt clip 34 for easy storage and a serrated band 36 for rotating or gripping the tube 20. In storage and transport, the rod 6 is substantially inserted into the carrying case 6 with a portion, generally the cylindrical end section 12, of the rod 4 projecting a small distance outward from tube 8 (not shown).

Figure 7A:
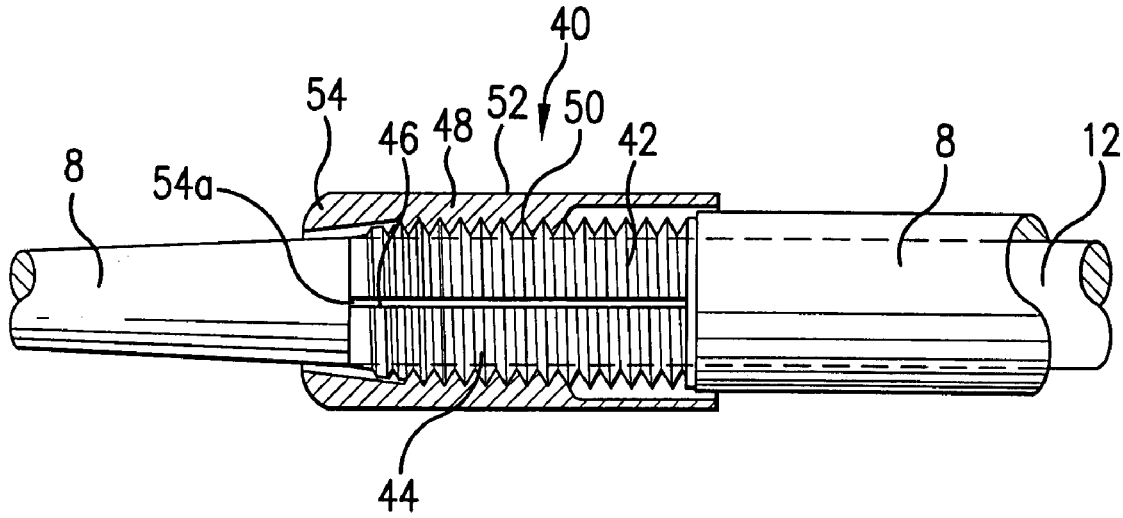
FIG. 7A is a side elevational view, with parts in section, of the cap locking mechanism in a released configuration.
Figure 7B:
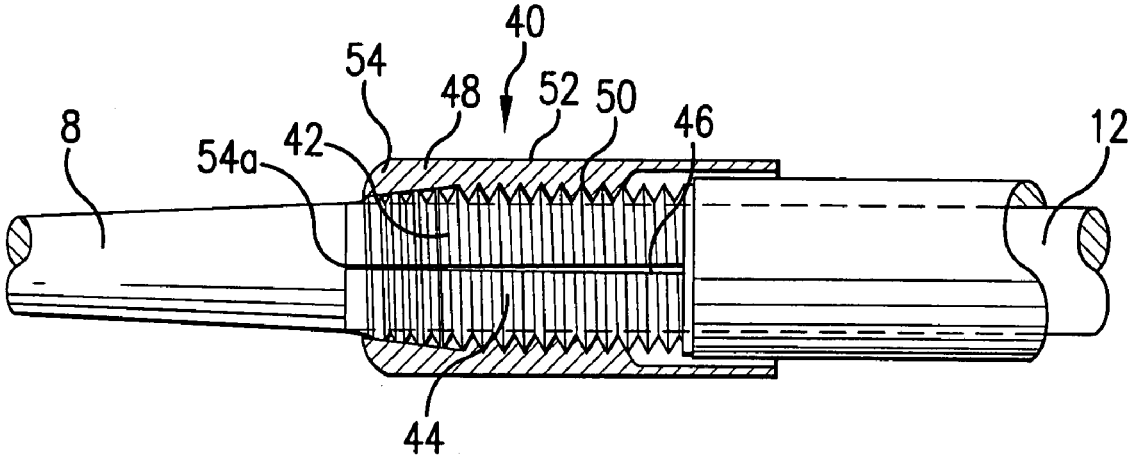
FIG. 7B is side elevational view, with parts in section, of the cap locking mechanism in a locked configuration.

Referring to FIGS. 7A and 7B, the locking and release mechanism 40 of the invention is shown. The end portion 42 of carrying case 4 is provided with outer threaded section 44 having a plurality of open ended slots 46, such as four slots. A hollow metal screw down cap 48 having internal threads 50 rotatably engages thread section 44 of the carrying case 6. The circumferentially extending outer surface 52 of the cap 48 is provided with serrated outer gripping surface to allow the cap to be rotated from a tightened lock position to retain the rod 6 within carrying case 4 as shown in FIG. 7B to a rod release position in FIG. 7A. As seen in FIGS. 7A and 7B, the outer peripheral section 54 surrounding rod 6 is wider and projects somewhat inward toward the outer threaded section 44 of the carrying case 4 to allow the cap to grip the rod 4 as the cap 48 is tightened down. This tightening is achieved by the slots 46 being compressed by the peripheral section 54 as seen at section 54*a*. The rod 4 can be released by rotating the cap 48 in the opposite direction to the release position of FIG. 7A at which the slot end portions expand to allow relative movement between the rod 6 and carrying case 4.

In use of the sharpener 2, the rod 6 is released from its carrying position and is pulled out a desired length from the carrying case 4 after which the cap 48 is rotated to retighten the rod 6 to perform a sharpening operation. Upon being tightened with sharpening end sections 8 or 12 selectively exposed, it will be apparent that the carrying case 4 serves also as a holder during a sharpening process. Dependent on which end section is desired to be exposed for sharpening, the rod 6 may be completely removed from the carrying case 4 and reinserted to expose the opposite end sections 8 or 12 as needed.

Figure 5:
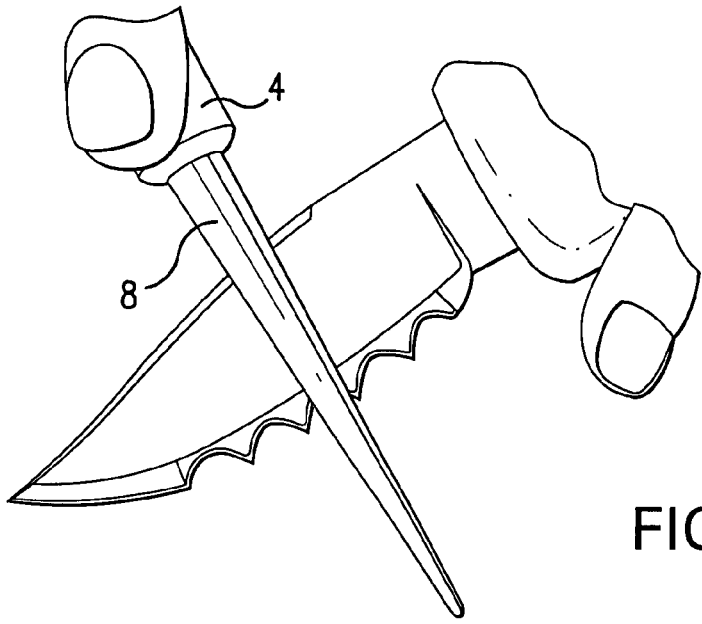
FIG. 5 is a perspective side view of the abrasive sharpener of FIG. 1 being used to sharpen a knife having a serrated edge.

Referring to FIG. 3, the sharpening of a flat edge of knife 80 is illustrated. With the carrying case 4 gripped by one hand and the knife 60 gripped by the other hand, either the tapered end 10 or round end 12, the latter preferred for flat edge knives, the rod 6 is tightened against movement in carrying case 4 exposing rod section 8 or 12. The knife 80 is then drawn down at a desired angle in contact with the abrasive surface to the end of the rod and for safety away from the carrying case 6. This procedure is repeated for desired sharpening results. In FIG. 4, the sharpening of serrated edges of knife 82 is shown using tapered end section 8 in an exposed position. The side of the knife 62 and the like should be sharpened with the knife at a desired angle and with the rod 6 being moved manually back and forth until sharp. In FIG. 5, a fishing hook 86 can be sharpened by placing it in the slot 18 and moving it back and forth. The foregoing uses are only described for illustration and the invention is not intended to be so limited. The edges of other knives, tools, hooks, or other implements may be also sharpened with the same or different sharpening techniques than as specifically illustrated in FIGS. 3-5.

What is claimed is:

1. A hand held abrasive sharpener comprising a rod extending along a longitudinal axis and having a first end section extending along said longitudinal axis, said first end section having a tapered, generally conical configuration;

an opposite end section extending from said first end section along said longitudinal axis, said opposite end section having at least a partially cylindrical configuration and a flat surface integral with said partially cylindrical configuration, said flat surface extending along said longitudinal axis, said first end section and said opposite end section respectively having abrasive surfaces on said tapered configuration, said cylindrical configuration, and said flat configuration for sharpening edges;

a carrying case for carrying said rod in a secured or release position, said carrying case having a locking mechanism means for releasably securing said rod to said carrying case for transport at a partially projected position within said carrying case with said first end section or said opposite end section projecting solely from said carrying case with said opposite end section or said first end section being positioned within said carrying case, and said rod having a cylindrical portion positioned generally intermediate of said rod between said first end section and said opposite end section along said longitudinal axis, said cylindrical portion contacting said locking means in said secured position.

2. The sharpener according to claim 1 wherein said rod includes a longitudinal open slot for sharpening other edges.

3. The sharpener according to claim 1 wherein said carrying case acts as a holder for a sharpening operation in said secured position of said rod.

4. The sharpener according to claim 1 wherein said locking mechanism has a cylindrical hollow cap having internal threads, said carrying case having an open end section for receiving said rod, said open end section having external threads for engaging said internal threads of said cap, said cap being moveable on said external threads from a position securing said rod to said carrying case to a position releasing said rod for movement relative to said carrying case.

5. The sharpener according to claim 4 wherein said open end section includes open end slots, said slots being compressible to cause said carrying case to grip said rod in said secured configuration.

6. A hand held abrasive sharpener comprising a rod extending along a longitudinal axis and having a first end section extending along said longitudinal axis, said first end section having a tapered, generally conical configuration and having an abrasive outer surface;

an opposite end section having at least a partially cylindrical configuration and an integral flat surface extending along said longitudinal axis; said cylindrical configuration and said flat surface having abrasive outer surfaces, said rod having a cylindrical portion positioned generally intermediate of said rod between said first end section and said opposite end section along said longitudinal axis, a holder for said rod, and said holder has a locking mechanism for releasably securing said rod to said carrying case in a tightened lock position at a projected position for a sharpening operation, said locking mechanism contacting said cylindrical portion in said tightened locked position.

* * * * *